US010816289B2

(12) United States Patent
Davidson

(10) Patent No.: US 10,816,289 B2
(45) Date of Patent: Oct. 27, 2020

(54) DOUBLE STACK BOX MAGAZINE FOR RIMMED CARTRIDGES OF VARYING LENGTH

(71) Applicant: Michael J. Davidson, New Carlisle, OH (US)

(72) Inventor: Michael J. Davidson, New Carlisle, OH (US)

(73) Assignee: MD Arms, Ltd., New Carlisle, OH (US)

( * ) Notice: Subject to any disclaimer, the term of this patent is extended or adjusted under 35 U.S.C. 154(b) by 0 days.

(21) Appl. No.: 16/733,279

(22) Filed: Jan. 3, 2020

(65) Prior Publication Data

US 2020/0278163 A1 Sep. 3, 2020

Related U.S. Application Data

(60) Provisional application No. 62/793,927, filed on Jan. 18, 2019.

(51) Int. Cl.
*F41A 9/69* (2006.01)
*F41A 9/70* (2006.01)

(52) U.S. Cl.
CPC . *F41A 9/69* (2013.01); *F41A 9/70* (2013.01)

(58) Field of Classification Search
CPC ..... F41A 9/69; F41A 9/70; F41A 9/65
See application file for complete search history.

(56) References Cited

U.S. PATENT DOCUMENTS 1,433,945 A 10/1922 Eickhoff
1,859,558 A 5/1932 Garand
2,383,998 A 9/1945 Vesely
2,391,756 A 12/1945 Vesely
3,196,568 A 7/1965 Reed
3,345,771 A 10/1967 Silsby
3,604,142 A 9/1971 Silsby
3,977,114 A 8/1976 Poor
4,589,218 A 5/1986 Teppa
4,672,760 A 6/1987 Chesnut et al.
4,777,752 A 10/1988 Howard
(Continued)

FOREIGN PATENT DOCUMENTS

WO WO-2019207328 A1 * 10/2019 ..... F41A 9/70

*Primary Examiner* — Stephen Johnson

(74) *Attorney, Agent, or Firm* — Wood Herron & Evans LLP

(57) ABSTRACT

A multi-column box magazine for rimmed ammunition cartridges of varied lengths has an elongated housing with a neck portion where cartridges are arranged in a single column and a mouth at an upper feed end through which cartridges are inserted and extracted. In a multi-column portion, cartridges are arranged in laterally alternating columns, and in a transition portion the alternating columns are transitioned into the single column as the cartridges are moved toward the mouth within the housing. A follower is biased by a spring toward the mouth. The multi-column portion has a forward interior surface limiting forward movement position of cartridges, which varies depending on individual cartridge length, and the neck portion having a forwardly sloped rearward wall which confronts the cartridge rim and shifts the cartridge forward, as needed, as cartridges are moved upwardly within the housing to the mouth.

6 Claims, 9 Drawing Sheets

(56) References Cited

U.S. PATENT DOCUMENTS

| | | | | | |
|---|---|---|---|---|---|
| 4,790,094 | A | | 12/1988 | Chesnut et al. | |
| 4,862,620 | A | * | 9/1989 | Chesnut | F41A 9/69 42/50 |
| 5,056,252 | A | | 10/1991 | Velezis | |
| 5,099,595 | A | * | 3/1992 | Chesnut | F41A 9/69 42/50 |
| 5,127,178 | A | | 7/1992 | Sinclair | |
| 5,235,769 | A | | 8/1993 | Stead et al. | |
| 5,367,810 | A | | 11/1994 | Stead et al. | |
| 5,375,359 | A | | 12/1994 | Chesnut et al. | |
| 5,507,110 | A | * | 4/1996 | Chesnut | F41A 9/65 42/50 |
| 5,592,769 | A | | 1/1997 | Villani | |
| 5,755,052 | A | | 5/1998 | Keeney | |
| 8,061,071 | B2 | | 11/2011 | Fitzpatrick et al. | |
| 8,448,364 | B2 | * | 5/2013 | Davidson | F41A 9/69 42/50 |
| 8,966,801 | B1 | * | 3/2015 | Bentley | F41A 9/71 42/50 |
| 2005/0188579 | A1 | | 9/2005 | Gates | |

* cited by examiner

DOUBLE STACK BOX MAGAZINE FOR RIMMED CARTRIDGES OF VARYING LENGTH

CROSS-REFERENCE TO RELATED APPLICATION

This application claims priority to U.S. Provisional Patent Application No. 62/793,927, filed Jan. 18, 2019, and incorporates the same herein by reference.

TECHNICAL FIELD

This application relates to box-type ammunition magazines, particularly to detachable multiple column (double stack) magazines for rimmed cartridges.

BACKGROUND

Typically, ammunition magazines for firearms fall into two broad categories: fixed and detachable. Box magazines may fall into either of these categories.

Rimmed cartridges present certain challenges for designing and manufacturing reliable ammunition feeding devices, particularly for higher capacity box magazines, not encountered with rimless cartridges. The most popular types of rimmed ammunition include shotgun shells and rimfire cartridges, the latter being used in rifles and pistols.

Unlike rifle and pistol ammunition which has a very consistent standardization in length of a live cartridge from most manufacturers and/or loads, shotgun ammunition typically has significant variations in live cartridge length from one manufacturer and/or load to the next. The spectrum of length variation for rifle and pistol ammunition can typically be measured in the hundredths of an inch (0.0X0") if not the thousands of an inch (0.00X"). The spectrum of shotgun ammunition can in some cases be measured at over an inch (X.00") of length difference from one manufacture to the next. And more typical in the tenths of an inch (0.X00").

Manufacturers typically call out shotgun ammunition in ¼ inch (0.25") or ½ inch (0.5") increments, for example, 2¾", 3", and 3¾". Typically, if a rifle or pistol cartridge has this much difference in length, it becomes a totally different round. For example; 9 mm Luger vs. .380 Auto, .45 Auto vs. .45 GAP, .22 Magnum vs. .22 Long Rifle vs. .22 Short, 8 mm Mauser (7.92x57) vs. 7.92x33 Kurz. Different shotgun models can typically fire everything it is chambered to (in a particular gauge) and all cartridges of shorter length. For example, the typical 12 ga shotgun that is chambered in 3" can fire both 3" and 2¾" cartridges. The typical rifle or pistol model cannot do this safely and/or reliably, the few exceptions not being relevant to this discussion.

Although shotgun cartridges are typically called out in nominal ¼ inch length increments, they still greatly vary from one manufacturer and/or load to the next. Typically, the length call-out is the length of the empty casing or hull. When it is loaded it loses length from crimping or rolling the casing/hull. Depending on the manufacturer and/or load, a live 2¾" cartridge can measure less than 2.25" in length or it can measure more than 2.55" in length.

Another difference is that the typical shotgun ammunition is a rimmed cartridge. Most pistol and rifle ammunition have evolved into a rimless cartridge, the exceptions, again, not being relevant to this discussion. The feeding of a double stack of rimless rifle or pistol cartridges in a box magazine does not typically encounter the problem of misaligned rims.

Box magazines achieve reliability by repeatability. A typical box magazine fed weapon uses an ammunition cartridge that is very consistent in length. This prevents front to back movement and misalignment of the cartridges in the magazine under forceful movement or recoil of firing the weapon. Magazine fed weapons have an optimal position of the next cartridge to load from the top of the magazine. For example, if the cartridge is not contained or restrained to prevent longitudinal (forward and aft) movement, the round can be positioned too far forward in the magazine as it is presented for chambering, causing misalignment, or can prematurely extract from the magazine. This results in a high probability of jamming during chambering of the cartridge. For typical shotgun cartridges, it can also allow the rim of a cartridge below the top cartridge to bind the rim of the top cartridge and cause a jam (failure to feed).

A box magazine for a shotgun presents a greater challenge because of the rim and shotgun cartridges' wide range of loaded length. For this reason, there were very few box-magazine fed shotguns. In the past, box magazines for shotguns have addressed this issue in only two ways, both of which include an upwardly angled stack provided by the follower. Either the cartridge was contained by holding the cartridge by its rim for the length of the magazine, preventing longitudinal movement (particularly forward movement of lower cartridges) and misalignment of cartridges and their rims. Or, it has restrained longitudinal movement (and resulting misalignment) by walls that bear against the head and forward end of the cartridge. This latter solution eliminates the use of all cartridges other than a very small portion of the spectrum of cartridge lengths. This includes many cartridges of the same nominal (call out) length. For example, not all 2¾" cartridges would fit and/or feed reliably with this method. This is not very feasible considering the wide range of lengths of shotgun cartridges. Moreover, the shooter who is very accustomed to the versatility in the typical shotgun model to except these different lengths of cartridges does not find this acceptable.

Putting two columns of rimmed shotgun cartridges side by side makes it impossible to contain the cartridges by holding their rims in alignment. The side of the rim toward the transverse center width of the magazine (inboard side) meets the column of cartridges beside it and cannot be contained. Therefore, longitudinal movement (particularly forward movement of a lower cartridge) and misalignment and binding of rims are possible—and likely.

In my prior U.S. Pat. No. 8,448,364, issued May 28, 2013, I disclosed a double-stack box magazine for rimmed cartridges that had a housing with a neck portion in which cartridges are arranged in a single column, a double-stack portion in which cartridges are arranged in laterally alternating columns, and a transition portion between the neck portion and the double-stack portion in which the two alternating columns are transitioned into the single column as the cartridges are moved toward the mouth within the housing. A pair of rim clearance channels, one on each of opposed interior lateral surfaces of the housing, have a first channel portion in which a width of the channels allows clearance for cartridge rims without respect to forward and rearward position of the cartridges within the housing, a second channel portion in the neck portion of the housing in which a forward edge of the channel provides an abutment against which laterally opposed areas of a cartridge rim bear to shift the cartridge to a rearward position within the housing as cartridges are moved toward the mouth, and a third channel portion providing transition between the first and second channel portions with a rearwardly sloped forward edge that confronts laterally opposed areas of a cartridge rim as cartridges are moved upwardly within the housing to the neck portion. This solution has been successfully employed on pump-action and semi-auto shotguns made or converted to use a detachable box magazine. It will not work, however, when architecture of the shotgun platform requires the double-stack portion and/or the transition portion needs to be shifted to the rear relative to the neck portion and mouth of the magazine.

SUMMARY

The present invention provides a new way of addressing this problem. In the double-stack portion, the rounds are allowed to shift forward and rearward without regard to head or rim position, limited in forward movement by the forward wall of the magazine body. The magazine tapers to a single stack feed at the top and, once single stack geometry is met, an angled back inside surface of the magazine body forces longer cartridges forward relative to the cartridge below it. The forward edges of the rim clearance channels guide one or both sides of the rim of the cartridge after it has been forwardly aligned to prevent the rims from binding during feed.

As in my prior design, this allows a very large variation of cartridge lengths, both within or beyond the same nominal length, to be fed reliably from the same magazine. That is, not only can cartridges of varying actual lengths within the same nominal size (such as 2¾") due to variation in manufacturer and/or load be mixed in the same magazine, cartridges of different nominal length (length call out, such as 3") can be mixed in the same magazine (such as 2¾" and 3", up to the maximum chamber length of the shotgun) without loss of feed reliability. Because only one side of a cartridge rim at a time can engage a slot or groove on the inside surface of the magazine body when the shells are in alternating columns, if the front-to-rear dimension of the magazine body is sized to accept shells of varying lengths, the rims cannot reliably be held in alignment against the recoil forces of firing the shotgun or other vibration, sudden movement, or impact. In this invention, the cartridges in the multi-column region are allowed to shift forward until their forward end touches the inside of the forward wall of the magazine body. The angled interior rear surface forces the rim of longer cartridges forward as it nears the top of the magazine, no matter how the shell has become situated during its travel up the magazine body, and it places the rim of upper cartridges in front of the rim of the next cartridge below it.

One embodiment provides a multi-stack box magazine for rimmed ammunition cartridges of varied lengths with an elongated housing, The elongated housing has a neck portion in which cartridges are arranged in a single column and has a mouth at an upper feed end through which cartridges are inserted and extracted. It has a multi-column portion, in which cartridges are arranged in laterally alternating columns, and a transition portion between the neck portion and the multi-column portion, in which the two (or more) alternating columns are transitioned into the single column as the cartridges are moved toward the mouth within the housing. A follower is configured to move along elongated guides in the housing and a spring is configured to bias the follower toward the mouth. A clearance channel is provided in at least one of opposed interior lateral surfaces of the housing. The channel has a first channel portion in which a width of the channel allows clearance for cartridge rims without respect to forward and rearward position of the cartridges within the housing, which varies depending on individual cartridge length. The cartridges may be allowed to shift forward until their forward end contacts the interior surface of the magazine body forward wall. A second channel portion in the neck of the housing has a forward wall of the channel which slopes forwardly to allow the cartridge rim to shift to a forward position within the housing as cartridges are moved toward the mouth. A third channel portion provides transition between the first and second channel portions and has a forwardly sloped rearward wall that confronts the rim of longer cartridges and shifts the cartridge forward as they are moved upwardly within the housing to the neck portion.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
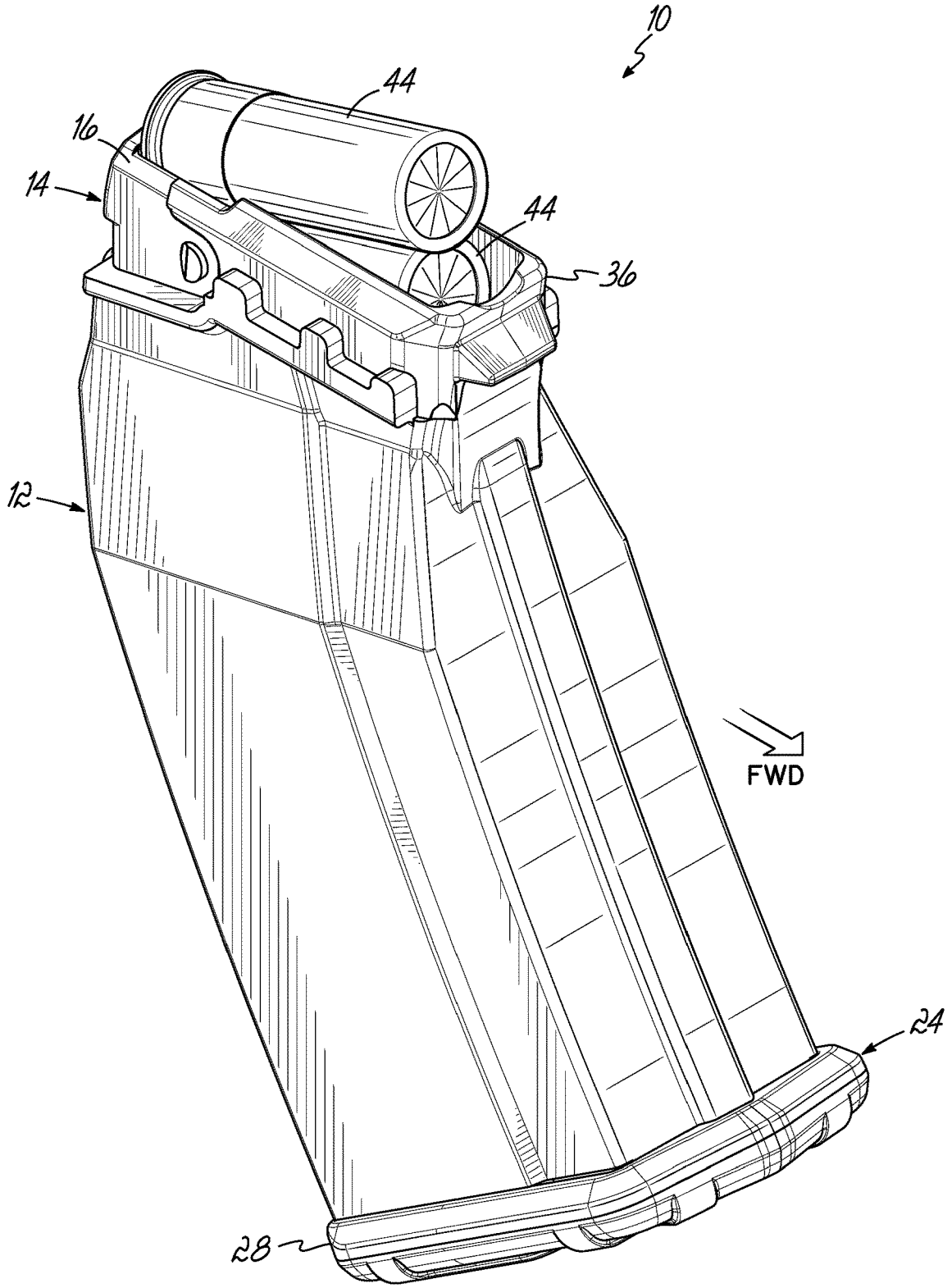
FIG. 1 is a pictorial view of a double-stack detachable box magazine for shotgun cartridges according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
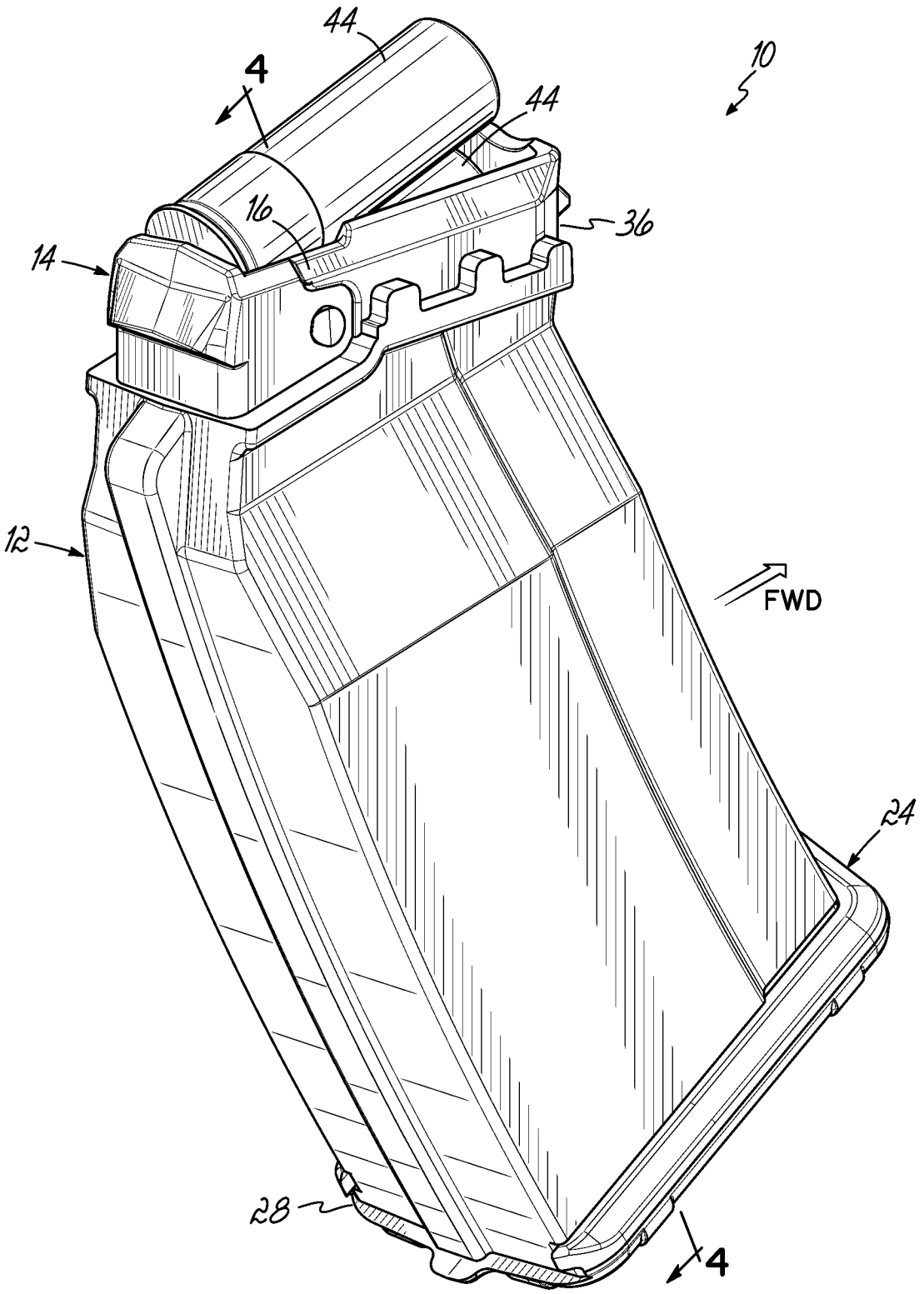
FIG. 2 is a pictorial view of the magazine shown in FIG. 1 from an alternate angle.
Figure 3:
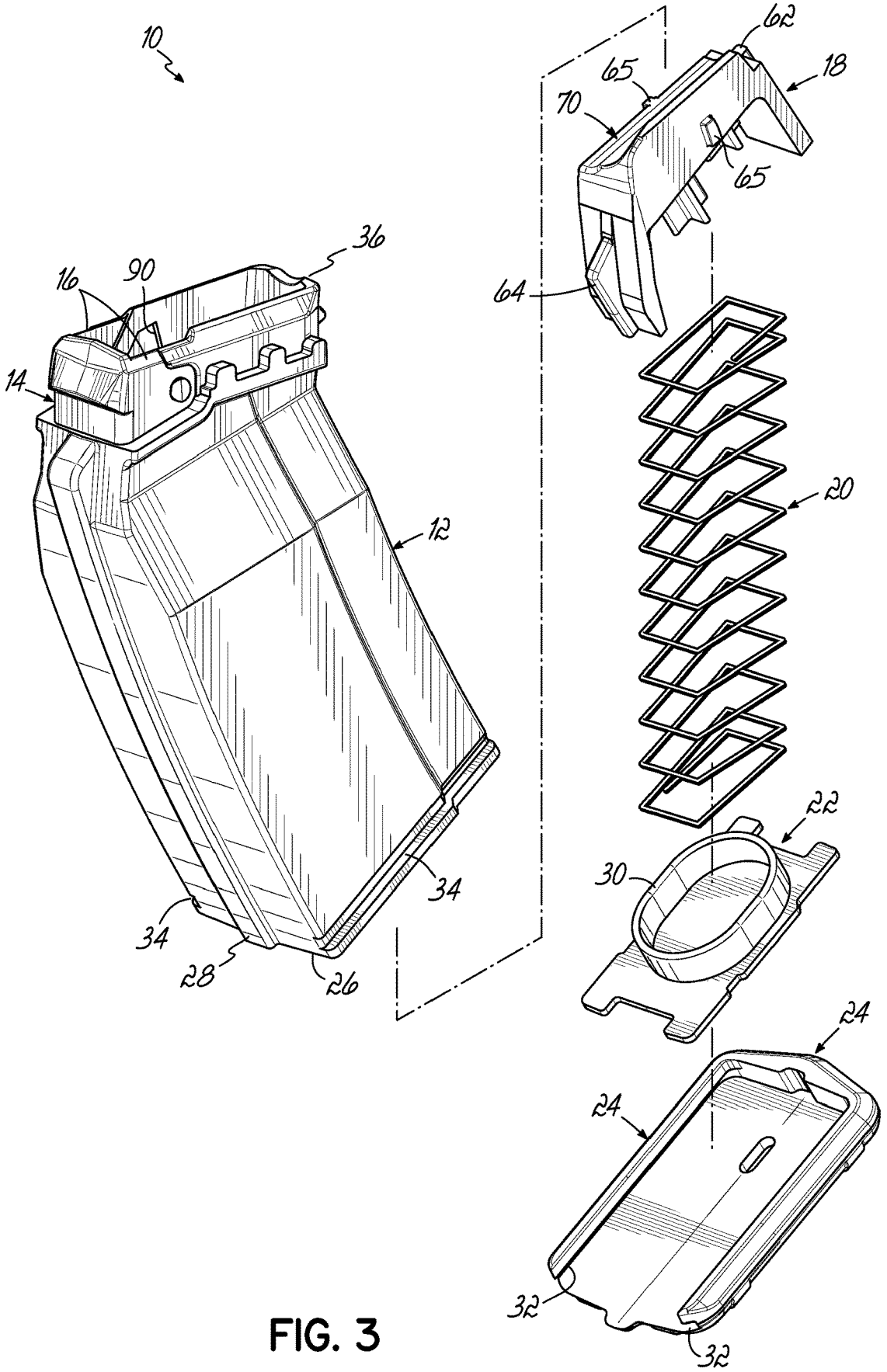
FIG. 3 is a pictorial exploded view thereof.

Referring to the various drawing figures, and first to FIGS. 1 and 2, therein is shown at 10 a magazine according to a preferred embodiment of the present invention. Referring now also to FIG. 3, which is an exploded view of the various parts of the magazine 10, it includes a magazine body 12, an attached metallic member 14, which provides feed lips 16 and snaps in place at an upper end of the magazine body 12. Also shown is a follower 18, a coil compression spring 20, a floor plate guide 22, and a floor plate 24. As is standard with any box magazine, it is assembled by inserting the follower 18 through an opening 26 at a bottom end 28 of the magazine body 12.

The coil spring 20 is inserted through the bottom opening 26 behind or along with the follower 18. The spring 20 may have a rectangular shape (as shown), may be a cylindrical or oval coil (not shown), or a combination of both, and its width or diameter may be tapered in cross-section along its length. In the present invention, it has been found useful to have a floor plate guide 22 with a recess, protrusions 30 or other means for holding the spring 20 in a properly centered position at the lower end. The floor plate guide 22 is inserted into the bottom opening 26 behind or along with the spring 20 and then the floor plate 24 is slid into a closed position by engaging the lateral grooves 32 on lateral rails 34, which are adjacent the bottom opening 26 of the magazine body 12.

For purposes of illustration only, the magazine 10 shown and described herein is adapted to fit one type of 12-gauge, pump-action shotgun. It is readily adaptable to other brands or to semi-automatic configurations that use detachable magazines. Likewise, the body 12 can be extended or shortened to accommodate almost any desired number of rounds and could be modified to accommodate more than two columns of cartridges. Accordingly, the upper end 36 of the magazine body 12 is configured to properly engage a detachable coupling with a magazine opening or well in such a shotgun (not shown). The illustrated embodiment includes an attached metallic member 14 that snaps in place adjacent the upper end 36 of the magazine body 12 to provide durable feed lips 16 in accordance with some existing designs found in a single-stack, smaller capacity box magazine for such a shotgun. Alternatively, feed lips may be provided integrally with the magazine body 12 either from the same material or by encapsulating/over-molding a metallic member and the attachment interface may be adapted to any shotgun platform that accepts detachable magazines.

Figure 4:
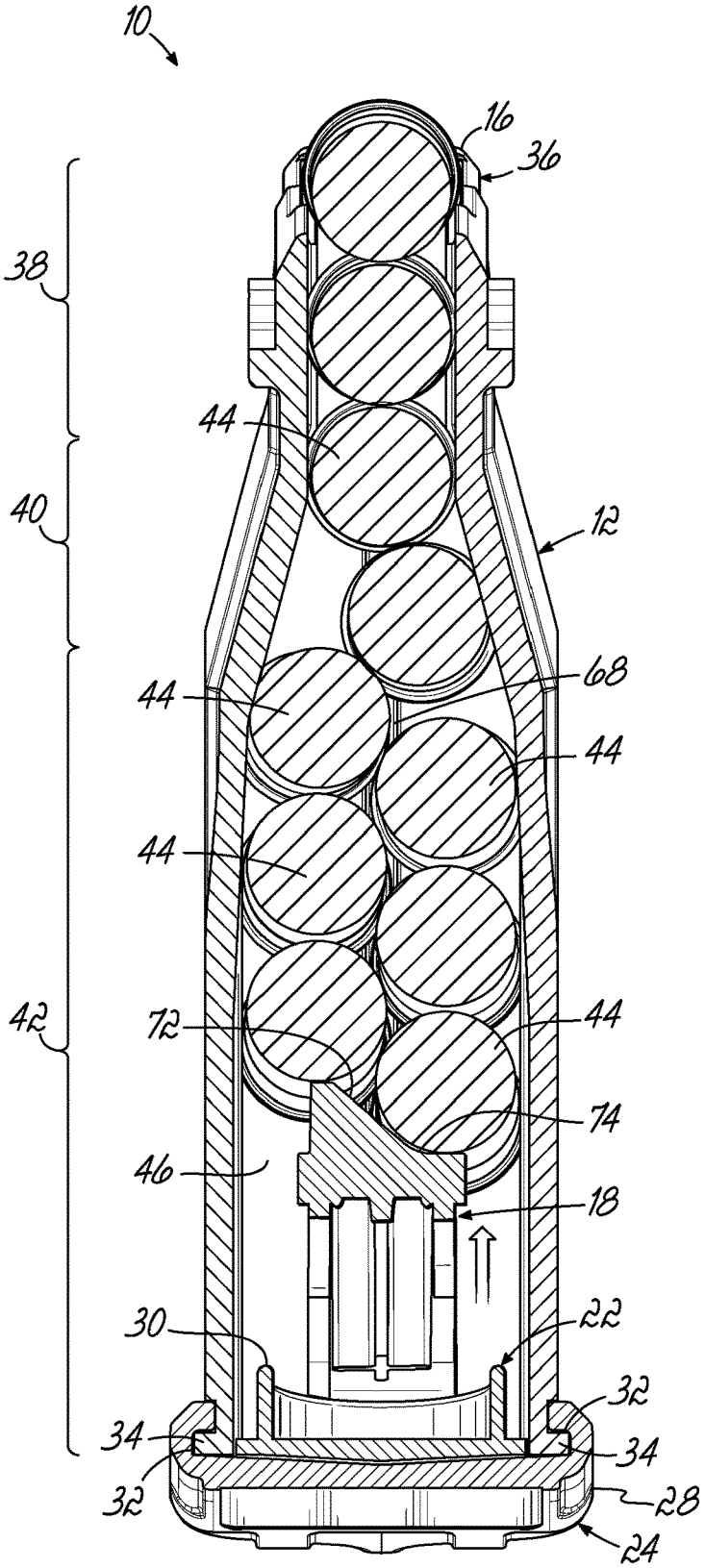
FIG. 4 is a longitudinal sectional view to the rear taken substantially along line 4-4 of FIG. 2 with the spring removed for clarity.

Referring now to FIG. 4, which shows a vertical sectional view of the magazine 10 (with the spring 20 removed), it can be seen that the magazine body 12 has three distinct regions: an upper or neck portion 38; a transition portion 40; and a widened double-stack portion 42. The upper or neck portion 38 at the upper end 36 of the magazine body 12 is dimensioned as a single-stack magazine to fit within the magazine opening or well of the shotgun. The standard magazine opening or well of currently-available shotguns cannot accept the added width of a double-stack magazine body. In the prior art, the need for this narrowed neck portion had presented a challenge in that the same follower must move a double row of cartridges along the wider double-stack portion and then completely push all cartridges through a transition to a narrow neck and fully into a delivery position. In the past, this problem has been addressed by either using a follower of exaggerated length, which consumes a greater portion of the magazine's length, or using hinged follower arms that displace into a more narrow profile as they enter the neck portion of the magazine, creating a complex and expensive-to-construct design. My prior invention addressed this issue differently, as will be more fully explained below, and many aspects of that design are used in the present invention, with novel modification to accommodate the rearward offset of the column.

As discussed in the background section above, reliably feeding shotgun shells in a box magazine presents challenges not found in handling rifle and pistol cartridges. Generally, a shotgun is expected to be able to handle and fire shells of the specified chamber length or shorter. Moreover, shells of any standard nominal length may vary considerably in actual length. Prior art box magazines rely on the length of each cartridge being substantially identical, within a very small acceptable tolerance and/or use of a significantly angled follower. Also, as described above, prior single-stack box magazines for shotgun shells address this challenge by engaging the rim of each cartridge on both sides within a narrow track or groove that maintained rims of subsequent cartridges in an "ordered" position and use a significantly angled follower to prevent binding caused by frontward/rearward shift to provide reliable feeding into a position to be stripped away by the shotgun's reciprocating bolt.

Figure 5A:
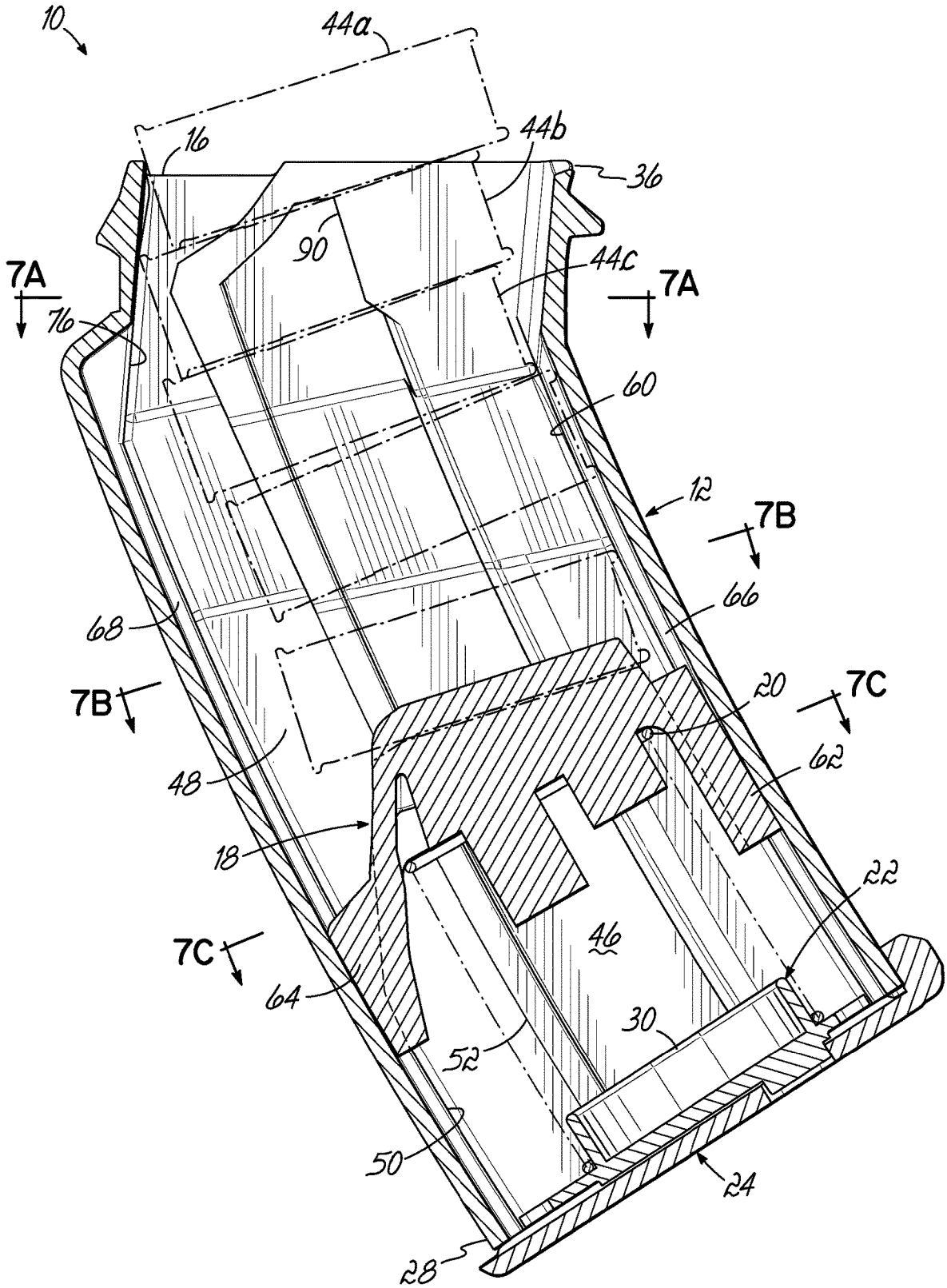
FIG. 5A is a lateral medial sectional view of the magazine, without a spring, showing cartridges in phantom line, and showing the follower in a lowered position.
Figure 5B:
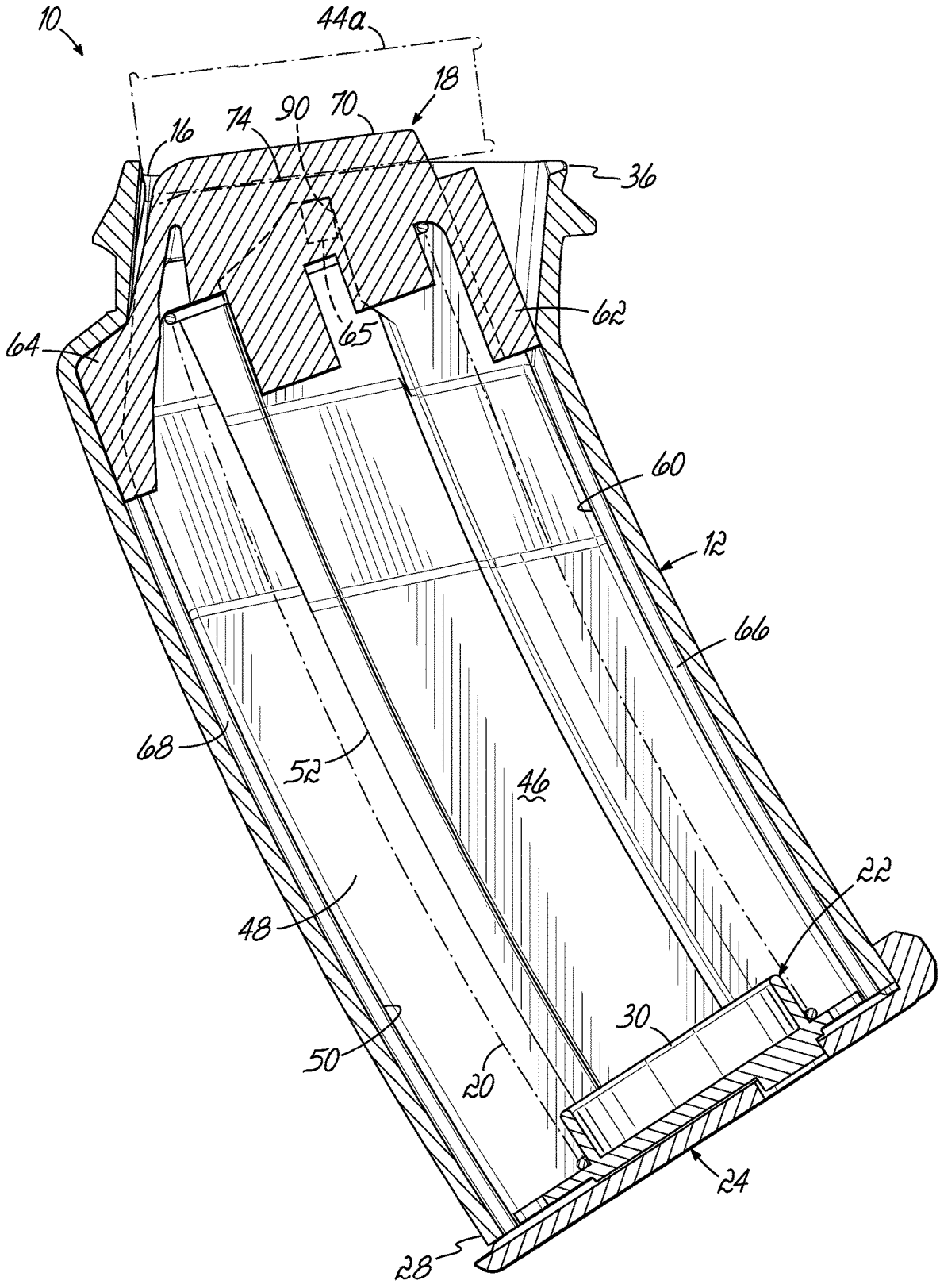
FIG. 5B is a similar view showing the follower in the topmost position.
Figure 6:
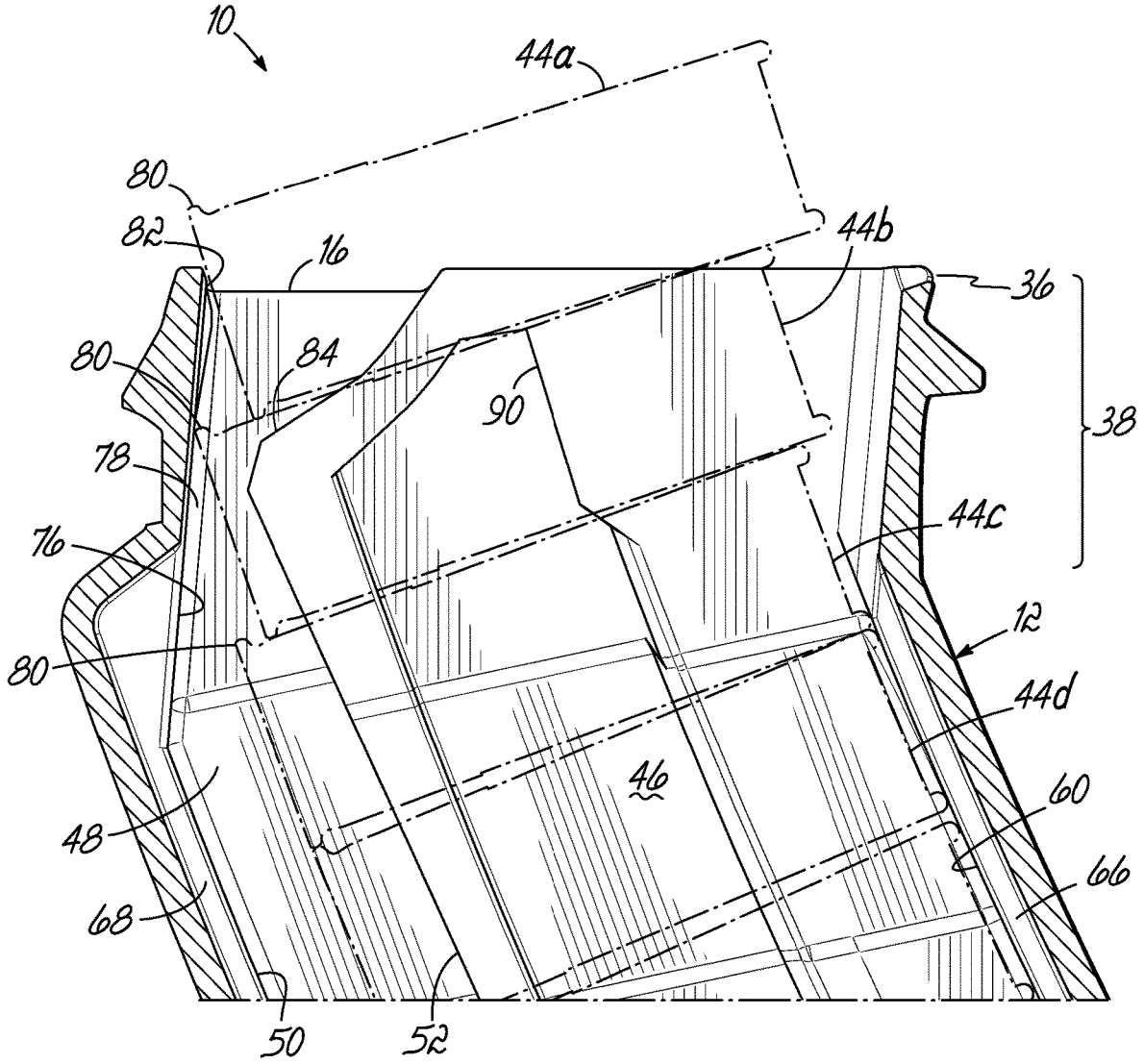
FIG. 6 is a lateral medial enlarged fragmentary sectional view of an upper part of the magazine with the position of rimmed cartridges shown in phantom.

Referring now to FIGS. 5A, 5B, and 6, therein are shown sectional views taken laterally substantially along the longitudinal center of the magazine 10. Cartridges 44 are shown in phantom line for clarity. In FIGS. 5A and 5B, no spring 20 is shown. The follower 18 is in a lowered position in FIG. 5A and in a topmost position in FIG. 5B. In FIG. 6, the magazine 10 is partially loaded with shotgun shells 44 of varied length, which are shown in phantom in this view. These views show the lateral interior surface 46 of the magazine body 12. The opposed lateral surface (not shown in this view) may be configured identically in a mirror image. Alternatively, the position of certain components can be vertically offset in one side relative to the other in order the balance the handling of the staggered double columns of shells 44.

Adjacent the rear edge of the magazine body 12 is a relatively wide rim clearance channel 48. A rear edge 50 of the channel 48 is defined along the rearward interior surface of the magazine body 12. A forward edge 52 of the channel 48 is defined on the lateral interior surface 46. In preferred form, however, the forward edge 52 is positioned to accommodate even the shortest nominal or actual length shotgun shells 44 without confronting the rim. The cartridges 44 are allowed to shift forward (as they are inclined to do in response to the recoil forces of firing the weapon) until their forward end contacts the forward interior surface 60 of the magazine body 12.

Figure 7A:
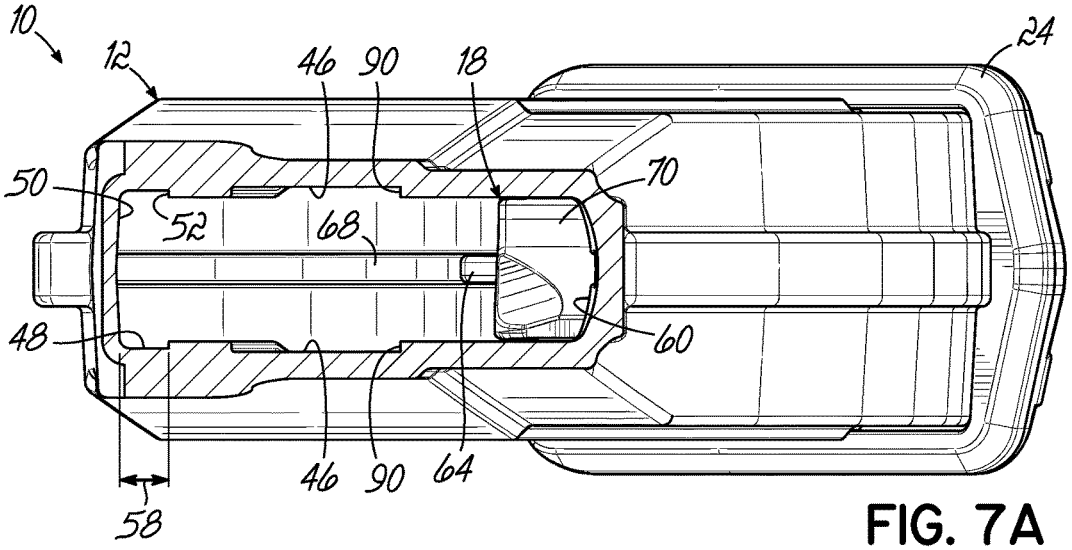
FIGS. 7A, 7B, and 7C are a cross-sectional views taken substantially along the corresponding lines indicated in FIG. 5A.
Figure 7B:
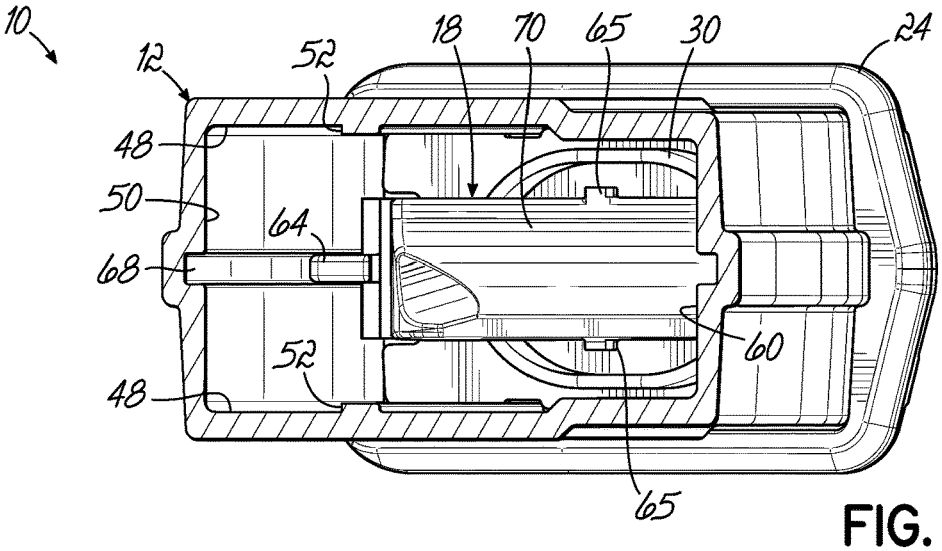
Figure 7C:
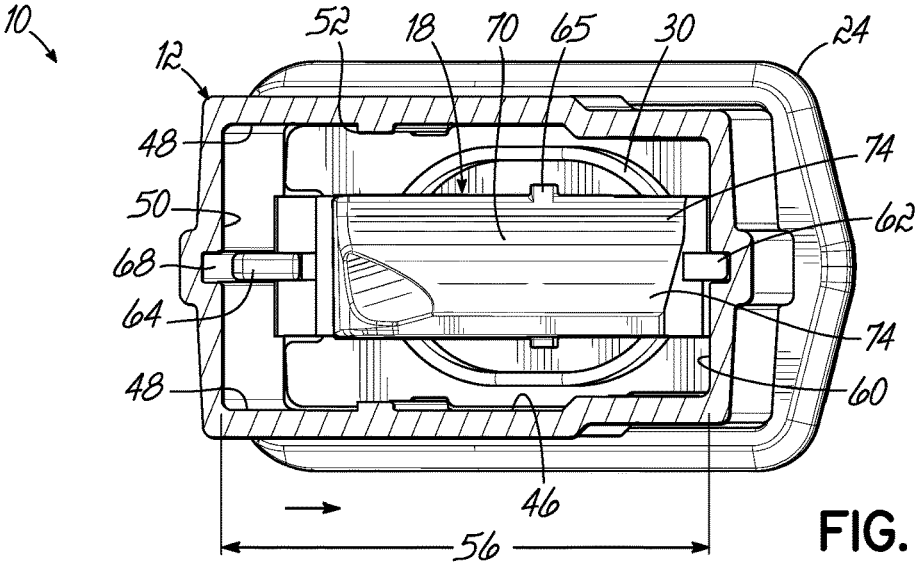
Figure 8A:
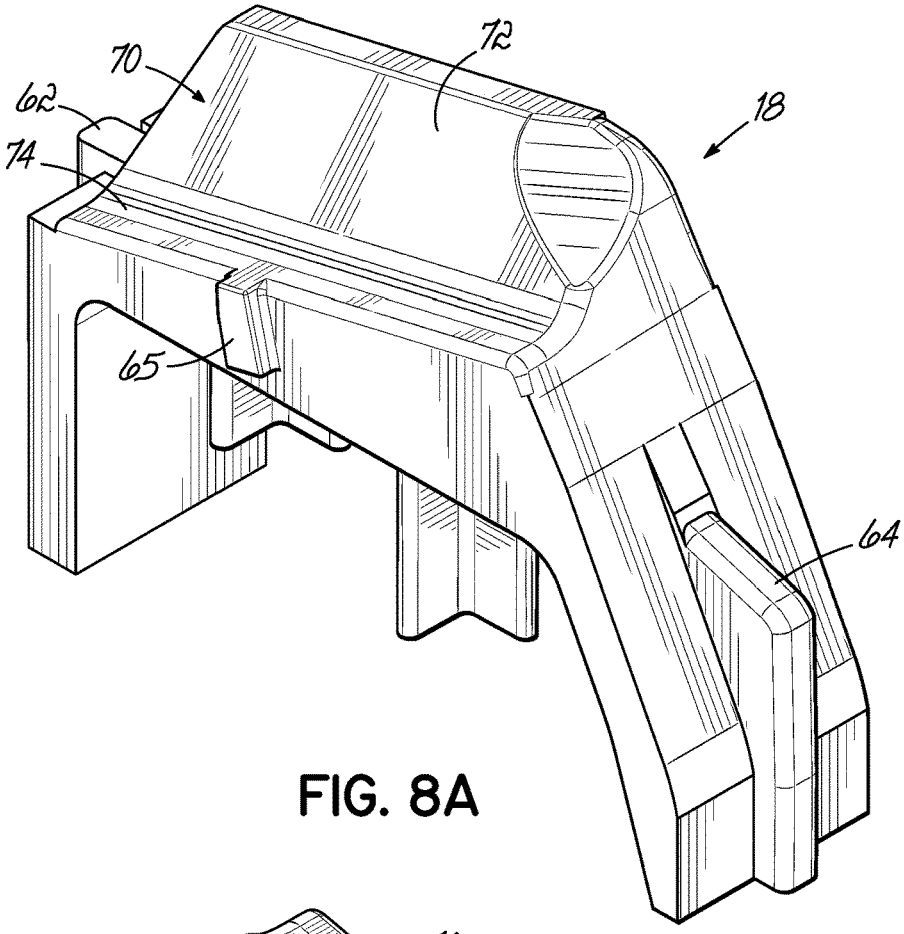
FIGS. 8A and 8B are isometric views of the follower.
Figure 8B:
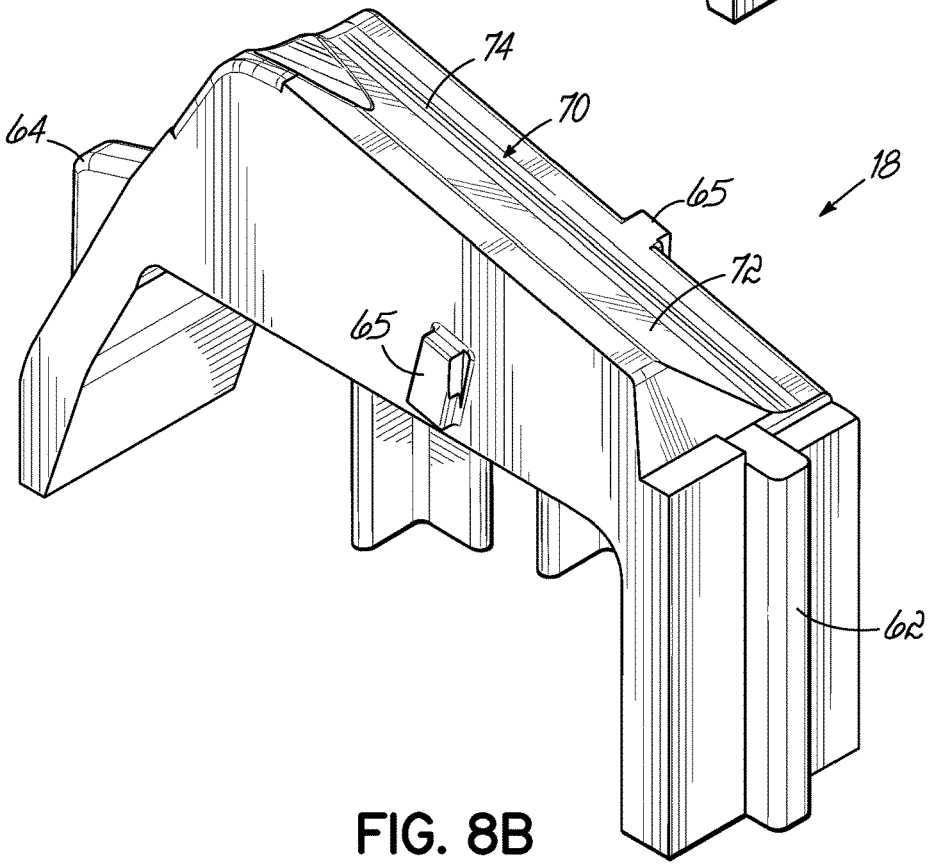

FIGS. 7A, 7B, and 7C show cross-sectional views taken substantially along corresponding lines of FIG. 5 and illustrate the relative lateral depth of the rim clearance channel 48 and lateral interior surfaces 46.

The overall front-to-rear interior dimension 58 (FIG. 7C) should be configured to accept the longest expected overall length of a shotgun cartridge 44 to be used in the magazine 10 and its associated shotgun (not shown). The front-to-rear dimension 56 of the rim guide channel 48 (FIG. 7A) optimally may be selected such that the rim of a shotgun shell of the shortest expected overall length will remain between rear and forward edges 50, 52 of the clearance channel 48 when a shell is shifted forward to the point of being against or near the forward interior surface 60 of the magazine body 12.

It can be appreciated by comparison of the views in FIGS. 4 and 7A-7C that while in the multi-column portion 42 of the magazine body 12, the alternating rows of shotgun shells 44 have their respective rims engaged in only one of the laterally opposed rim guide channels 48. Because only a very minor portion of the cartridge rim could be engaged in the clearance channel 48 in the double-stacked portion 42 of the magazine 10, it has been found that the rearward shock forces to which an attached magazine 10 is subjected when the shotgun is fired (or even when dropped or otherwise impacted) is likely to jar the cartridges 44 out of a narrow guide channel until the cartridge comes to rest against the forward interior surface of the magazine. Thus, the present design allows this inevitable movement to occur, while maintaining containment of a rim portion of each cartridge 44 in one of the rim clearance channels 48, which are relatively wide in the double-stack portion 42. The space forward of the forward edge 52 to the forward interior surface 60 is such that the rim of the shortest expected round will remain in the channel 48 when the mouth end of a cartridge 44 contacts the forward interior surface 60.

Referring now also to FIGS. 8A-8D, the follower 18 has forward and rearward guide rails 62, 64, which engage forward and rearward follower guide channels 66, 68 on interior front and rear surfaces 60, 50 of the magazine body 12. The follower guide rails 62, 64 have sufficient vertical length to prevent lateral tipping of the follower 18 as it travels along the length of the magazine body 12. The forward follower guide rail 62 can be longer in vertical dimension than the rear follower guide rail 64 in the illustrated design to accommodate the curvature of the magazine body 12, as can be appreciated by a comparison of FIGS. 5A and 5B. The follower 18 may also include lateral guide rails 65 (shown in FIGS. 8A and 8B) that guide the follower 18 as it approaches its upper limit of travel and prevent forward/rearward tipping by contact with an interior edge 90 when the topmost position is reached (FIG. 5B).

As best illustrated in FIGS. 4 and 8A-8D, the upper surface 70 of the follower 18 may be, for example, divided laterally into a raised convex or flat portion 72 and a lower concave portion 74. The lower concave portion 74 cradles and guides a cartridge 44 against a lateral interior surface 46 of the magazine body 12. In combination, the upper convex portion72 of the follower 18 and an adjacent cartridge 44 guides another cartridge 44 against the opposing lateral interior surface 46, maintaining portions of each cartridge rim in engagement with one of the rim guide channels 48 on each respective side. The height difference between the raised flat or convex portion 72 and lower concave portion 74 maintains sequential cartridges 44 in a vertically staggered relationship, as well as their laterally staggered relationship. Other shapes for the upper surface of the follower 18 may be selected, as desired, in order to balance the resistance of both columns of cartridges 44.

As cartridges 44 are fed from the upper end 36 of the magazine 10, cartridges 44 situated lower in the magazine 10 are moved from the double-stacked portion 42 into the transition portion 40, where their relative vertical position increases as their relative lateral position decreases. This is best illustrated in FIG. 4.

As cartridges 44 continue to be moved upwardly, through the transition portion 40, they enter the upper or neck portion 38 of the magazine 10, in which the cartridges 44 become vertically aligned in a single column with opposing edges of their rims both engaged in both opposing rim clearance channels 48. In a preferred form, the vertical length of the neck portion 38 is kept to the minimum length necessary to engage the magazine opening or well (not shown) of the selected shotgun, so that the combined transition portion 40 and double-stacked portion 42 of the magazine 10 may be maximized, thereby maximizing the capacity of the magazine 10.

Referring again in particular to FIG. 6, therein is shown an enlarged view of an upper portion of the magazine 10 seen in FIG. 5A. The shotgun cartridges 44 are shown in phantom line in order to better view internal details of the magazine body 12 and are labeled individually as 44a through 44d for clarity of discussion. Before the cartridges 44 reach the transition portion 40, excessive forward movement of the cartridges is limited by the forward interior surface 60 of the magazine body 12. This presents shorter cartridges to be presented in an appropriate forward/aft position as they reach the neck portion 38. At or near the bottom of the neck portion 38 of the magazine body 12, the back edge 50 of the rim clearance channels 48 angle toward the front edge 52, narrowing the front-to-rear width of the channel 48. The rear edge 50 of the channel 48 (which is the rear wall of the magazine body 12) presents an angled transition edge 76 which progressively decreases the width of the channel 48 toward a relatively narrowed rim guide channel 78. When cartridges 44a, 44b are in the neck portion 38, they are no longer limited in forward movement. Longer cartridges may be pushed forward by the rear edge surface 76, to the extent necessary, so they will be in an appropriate forward/aft position as they reach the feed lips 16 at the mouth of the magazine body 12.

As cartridges 44 are stripped from the upper end 36 of the magazine 10, cartridges at a lower position, such as that shown as 44c, migrate upwardly. Longer cartridges are pushed forward by the angled transition edge 76 to a position generally represented by cartridge 44b. At this point, even if the rims 80 of the cartridges 44 are "misaligned," each cartridge 44 is moved forward until the rim 80 is positioned forward of the rim of the cartridge below it. This movement reorients the uppermost cartridge 44a relative to the cartridge 44b below it, and forces the rim 80 into appropriate alignment. In this position, the rim 80 of the cartridge 44a is pressed against the feed lips 16 by spring pressure and is in position to be stripped away and chambered by the bolt of the firearm. This configuration allows the transition portion 40 and double-stack body portion 42 of the body 12 to be situated to the rear of the mouth at the upper end 36, which was not possible in my prior design.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A multi-column box magazine for rimmed ammunition cartridges of varied lengths, comprising:

an elongated housing having a neck portion in which cartridges are arranged in a single column and having a mouth at an upper feed end through which cartridges are inserted and extracted, an elongated multi-column portion in which cartridges are arranged in laterally alternating columns, and a transition portion between the neck portion and the multi-column portion in which the two alternating columns are transitioned into the single column as the cartridges are moved toward the mouth within the housing;

a follower configured to move in the housing;

a spring configured to bias the follower toward the mouth; and the multi-column and transition portions having a forward interior surface limiting forward movement position of cartridges, the position of the cartridge rim varying depending on individual cartridge length, and the neck portion having a forwardly sloped transition edge surface on the interior rearward wall which confronts the cartridge rim and shifts the cartridges forward, to a position with the rim forward of its forwardmost position in the multi-column and transition portions as the cartridges are moved upwardly within the neck portion to the mouth.

2. The magazine of claim 1, further comprising a clearance channel in at least one of opposed interior lateral surfaces of the housing, the channel having:

a first channel portion in which a width of the channel allows clearance for cartridge rims without respect to forward and rearward position of the cartridges within the housing, the forward movement position varying depending on individual cartridge length, a second channel portion in the neck portion of the housing in which a forward wall of the channel slopes forwardly to allow the cartridge rim to shift to a forward position within the housing as the cartridges are moved toward the mouth, and a third channel portion providing transition between the first and second channel portions and having a forwardly sloped rearward wall which confronts the cartridge rim and shifts the cartridges forward as the cartridges are moved upwardly within the housing in the neck portion.

3. The magazine of claim 1, wherein the housing is detachable from a firearm.

4. The magazine of claim 1, wherein the housing is forwardly curved.

5. The magazine of claim 1, wherein the follower moves along elongated guides configured at forward and rearward interior walls of the housing and extend substantially the full length of the multi-column portion.

6. The magazine of claim 5, wherein the follower is configured to move along the guides to a position substantially completely within the neck portion of the housing.

* * * * *